United States Patent [19]

Temple

[11] Patent Number: 4,977,031

[45] Date of Patent: Dec. 11, 1990

[54] MATERIAL FOR PACKAGING A MOISTURE-SENSITIVE PRODUCT, A PROCESS FOR THE MANUFACTURE OF SUCH MATERIAL, AND PACKAGING COMPRISING SUCH MATERIAL

[75] Inventor: Robert Temple, Saint Yrieix, France

[73] Assignee: Societe Charentaise de Participations, S.A., Barbezieux, France

[21] Appl. No.: 938,553

[22] Filed: Dec. 1, 1986

[30] Foreign Application Priority Data

Dec. 3, 1985 [FR] France ..... 85 17879

[51] Int. Cl.[5] ..... B32B 15/00

[52] U.S. Cl. ..... 428/463; 428/458; 428/461; 428/507; 428/508; 428/511; 428/537.5; 426/126

[58] Field of Search ..... 428/511, 508, 537.5, 428/509, 458, 461, 463; 426/126

[56] References Cited

U.S. PATENT DOCUMENTS 4,123,566 11/1986 Kastl et al. ..... 428/508
4,248,912 2/1981 Gerigk et al. ..... 428/508
4,397,337 8/1983 Porrmann et al. ..... 428/36
4,467,012 8/1984 Pedersen et al. ..... 428/508

FOREIGN PATENT DOCUMENTS 696373 5/1953 United Kingdom .

*Primary Examiner*—Edith Buffalow
*Attorney, Agent, or Firm*—Mason, Fenwick & Lawrence

[57] ABSTRACT

A packing material, generally in sheet form, is made from a combination of a support sheet and a water-retentive material that is intimately connected to the support sheet. Moisture or exudate originating from a product enclosed by the packing material is absorbed and retained by the water-retentive material without affecting the physical strength of the support sheet or the packaged product. In a preferred embodiment, the support sheet is made of paper or a polymeric material, such as polyethylene, and the water retentive material is formed from polyacrylonitrile, or an acrylonitrile based co-polymer, treated with an alkaline aqueous solution of aliphatic or cycloaliphatic monofunctional or polyfunctional alcohols that have melting points greater than or equal to 110° C. The packaging material is ideal for the packaging of moisture sensitive foods, such as cheese.

10 Claims, 2 Drawing Sheets

MATERIAL FOR PACKAGING A MOISTURE-SENSITIVE PRODUCT, A PROCESS FOR THE MANUFACTURE OF SUCH MATERIAL, AND PACKAGING COMPRISING SUCH MATERIAL

This invention relates to a material for packaging a moisture-sensitive product, a process for the manufacture of such material, and packaging comprising such material.

More precisely, the invention relates to materials in the general form of sheets, adapted more particularly to the packaging of products such as cheeses, meat, and so on. The function of such packaging is to protect the packaged product from the external ambient atmosphere, and from any accidental contact. Such packaging also has the function of having selective gas and moisture permeability, in view of the changes that the packaged product may undergo, and which may even be such as to spoil the product, more particularly its taste.

Finally, and as indicated hereinbelow, packaging of this kind is intended to control the moisture and/or the exudate originating from the packaged product.

Packaging is already known which has as its declared object to meet these requirements. Thus in a first known embodiment (French patent No. 1 433 389), a meat packaging comprises a base formed by a single sheet of cellulose fibres, more particularly paper, and a water-impermeable agent disposed on the outer surface of the sheet of cellulose fibres or at least partially impregnating the same. The water-impermeable agent may be a urea-formaldehyde resin. According to this patent, such packaging is moisture-resistant while at least partially allowing aqueous liquids to pass through the fibres. However, such packaging does not enable the function of mutual gas exchanges to be performed between the packaged product and the external ambient atmosphere because of the presence of the impermeable agent. Nor does such packaging allow the function of absorption of the moisture originating from the packaged product, except to a very limited degree.

In a second embodiment (UK patent No. 696 373), the packaging comprises a layer of moisture-absorbent fibres, more particularly paper, and a moisture-resistant film, provided with small perforations (synthetic resin). Such a packaging may be disposed on the meat for packaging in either direction, but the packaging described in this patent is for use limited to meat, and undoubtedly of limited efficacy.

In a third embodiment (French patent No. 875 277), a packaging is provided which comprises a sheet or strip of metal covered with a thin thermoplastic sheet adapted to absorb the moisture or a liquid by swelling. A packaging made in this way is sealing-tight but is basically intended to provide a container of the tin can type.

The invention relates to a material adapted to the production of packaging for moisture-sensitive products, which is capable of controlling the moisture of the atmosphere surrounding the product thus packed.

To this end, the invention proposes a material which is formed in combination by at least one support sheet and at least one water-retentive material intimately connected to the support sheet by connecting means. A material of this kind is intended for the packaging of a moisture-sensitive food or other product and its function is to control the moisture and/or exudate from the product thus packed.

The moisture and/or the exudate originating from the packaged product is absorbed and retained by the water-retentive material without affecting the physical qualities of the support sheet, more particularly its stability, and without affecting the packaged product itself. Also, because of its constitution, the material according to the invention is capable of some desorption, absorption and desorption depending upon the moisture and the temperature inside the packaging and on the temperature in the external ambient atmosphere.

The invention may be embodied in various ways: the support sheet may be a single layer or a multi-layer sheet; it may be gas and/or water vapour proof or, on the other hand, permeable. The water-retentive material may be incorporated in or superimposed on the support sheet. The water-retentive material itself may be in the form of a resin or some other material. The resulting material may comprise one or more layers.

The other features of the invention will be apparent from the following description with reference to the accompanying drawings wherein.

Figure 1:
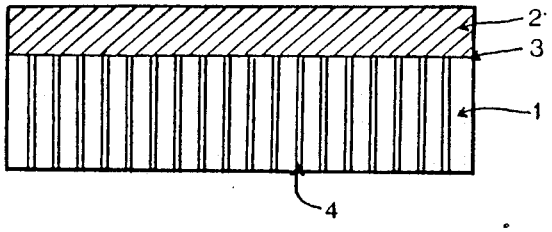
FIGS. 1, 2, 3 and 4 are four diagrammatic cross-sections showing four embodiments of the material according to the invention.

The invention relates to a material adapted to the packaging of a product; a process for the manufacture of such material; and a packaging comprising such material and intended for said product.

The product itself for which the packaging is intended does not directly form part of the invention. It is preferably a moisture-sensitive product, the function of the packaging being to control the moisture and/or the exudate originating from said product after it has been packaged. Such a product may be a food product such as cheese, meat, fish, biscuits or some other live product such as flowers, or, finally, products such as mechanical, electronic or electrical components.

The material according to the invention is characterised in that it comprises in combination at least one support sheet 1 and at least one water-retentive material 2 intimately connected to the support sheet byu connecting means 3.

A material of this kind makes it possible to produce a packaging for the said product and its function is to control the moisture and/or exudate originating from the product.

The basic function of the support sheet 1 in the material according to the invention is to provide physical stability of the material and form a support for the water-retentive substance.

The material according to the invention may be embodied in various ways. These various embodiments arise out of the various embodiments of the support sheet 1, the water-retentive substance 2, the connecting means 3, and the actual constitution of the material. These different variants in the embodiment of the constituent means of the material may be combined with one another.

The support sheet 1 is generally a flat element in the form of a sheet, a web, or strip or any other form; it may be flexible or rigid; shapeable to form a packaging; and at all events have a certain mechanical stability. The support sheet 1 comprises either a single layer or a plurality of layers. It may be homogeneous or heterogeneous. It is gas and/or water vapour proof or alternatively it may be gas and/or water vapour permeable. It is either containous or alternatively discontinuous. It is provided with perforations or microperforations 4 with or without the removal of material or, alternatively, has no such perforations.

The material making up the support sheet 1 is preferably selected from the group comprising paper, cellulose films, regenerated pure cellulose, and the polymers, more particularly polyethyelene, polypropylene, polyvinylchloride, and polyester.

In particular, the material making up the support sheet is a polymer having micropores or some permeability to water vapour.

According to the invention, the term "gas and/or water vapour permeable support sheet 1" denotes a support sheet having oxygen-permeability greater than 18 $cm/m^2$ 0.24 hours and water vapour permeability greater than 750 $g/m^2$ 0.24 hours. The term "gas and/or water vapour proof support sheet " denotes a support sheet having a permeability at values less than those mentioned above.

According to another possible embodiment of the invention, the support sheet 1 is in turn connected to at least one other additional sheet, more particularly an aluminim foil.

The water-retentive substance 2 may be a water-retentive resin selected from the group comprising the polyacrylonitriles or acrylonitrile-based copolymers treated with alkaline aqueous solutions of aliphatic or cycloaliphatic mono or polyfunctional alcohols, having a melting point greater than or equal to about 110° C.; polymers produced by the polymerization of starch in dispersion in water and a saturated monomer having a melting point greater than or equal to about 100° C.; polycarboxyalkyl celluloses; metallic salts of hydrolysed starch copolymers; copolymers of acrylic acid and α-olefines, or styrenes, or substituted styrenes; and polysaccharide derivatives containing carboxyl groups.

More generally, a water-retentive resin of this kind has the property of having a final weight, after absorbing water, equal to many times the initial weight before water absorption. This multiplication factor for the weight of the water-retentive resin may more particularly be as much as or more than 400.

In a second embodiment, the water-retentive material 2 is selected from the group comprising reaction products of graft starch-polyacrylonitrile copolymers and a polyfunctional alcohol; salified ogilosaccharide-acrylic copolymers; hydrocolloidal polyelectrolytes; products based on starch, casein or similar products; polyalcohols, more particularly glycerin, and glycol derivatives.

In a third embodiment, the water-retentive material 2 is formed by cellulose fibres, more particularly such as cotton.

In a fourth embodiment, the water-retentive material 2 is formed by mineral salts, more particularly sodium chloride.

Finally, in a fifth and last possible embodiment, the water-retentive material 2 comprises one or more composites, more particularly paper or a non-woven The water-retentive material is generally in solid, homogeneous or heterogeneous form depending upon the composition.

The water-retentive material 2 also has the property of being capable of intimate connection permanently to the support sheet so as to form a unit therewith. In particular, the water-retentive material 2 remains connected to the support sheet 1 even after water absorption.

The water-retentive material 2 is connected to the support sheet 1 either by being incorporated therein or being superimposed thereon. In the latter case, the water-retentive substance may be disposed on one of the surfaces or on both surfaces of the support sheet 1.

The water-retentive material 2 is distributed, generally continuously or, alternatively, discontinuously, inter alia spotwise, linewise, and so on.

The amount of water-retentive material 2 is adapted to the amount of water requiring to be absorbed, depending upon the product for packaging, in accordance with the knowledge of the skilled addressee.

The funciton of the means 3 connecting the water-retentive material 2 to the support sheet 1 is to provide cohesion of the material and this also applies after the water-retentive material has absorbed a quanity of water which may be very considerable.

The connecting means 3 may also be embodied in various ways. They may comprise the water-retentive substance itself, with some adhesive power, or be formed by an additional substance, such as an adjuvant.

The use of these connecting means is described subsequently by reference to the process for the manufacture of the material according to the invention.

As already stated hereinbefore, the various embodiments of the support sheet 1, water-retentive material 2, and connecting means 3 may be combined with one another. Also, the material according to the invention may comprise a combination of several of the constituent means described hereinbefore, e.g. a plurality of materials making up the support sheet and/or a plurality of water-retentive materials and/or a plurality of connecting means.

In its simplest elementary embodiment, the material thus produced is in the form of a single layer. However, such layer may in turn comprise one or more support sheets and/or one or more water-retentive materials.

Also, and as an alternative, the material may comprise a plurality of elementary layers as defined, said layers being either intimately interconnected or not.

FIG. 1 illustrates an elementary embodiment of the invention comprising a support sheet 1 having perforations 4 and intimately connected to a water-retentive material 2 by connecting means 3.

Figure 2:
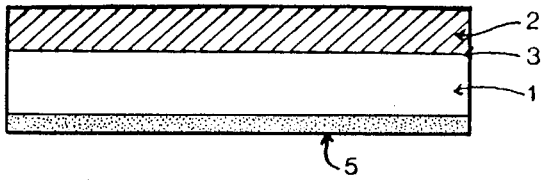

FIG. 2 illustrates a second embodiment of the invention comprising two support sheets, namely an aluminum foil 5 and a support sheet 1, the latter being intimately connected to a water-retentive material 2 by connecting means 3.

Figure 3:
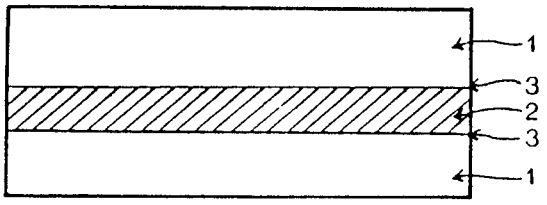

FIg. 3 illustrates a third embodiment of the invention comprising two support sheets 1 intimately connected respectively to the top and bottom surfaces of a water-retentive material 2 by connecting means 3.

Figure 4:
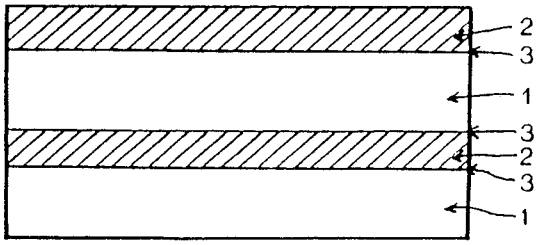

FIG. 4 illustrates a fourth embodiment of the invention comprising the superposition of two elementary layers of material according to FIG,. 1, which are in turn intimately connected by connecting means 3.

Some examples given hereinafter will illustrate various possible embodiments of such material without any limiting force.

The invention also relates to a process for the manufacture of a material as described hereinbefore. In such process, a support sheet 1 and a water-retentive material 2 as defined hereinbefore are used and are permanently intimately connected by connecting means 3. The latter mainly use adhesive power either of the water-retentive material or, as already indicated, of additional substances. The substance having this adhesive power is either sprayed or coated on the support sheet and/or the water-retentive material or alternatively mixed intimately with the water-retentive material 2, more particularly with a varnish or an ink.

Spraying or coating is carried out continuously or alternatively in localized form, inter alia, spotwise or linewise.

Figure 5:
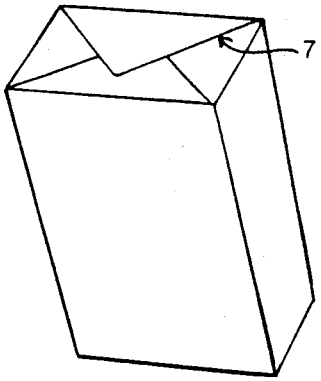
FIG. 5 is a diagrammatic perspective of a package made from the material.

The invention also relates to a package for a moisture-sensitive product, as indicated hereinbefore, using the above-described material. Such package (FIG. 5) may comprise at least one layer of such material adapted to form a packet by means of at least one fold 7 and/or a bend. This layer has characteristics such that it can be welded and/or stuck on itself so as to form a packet which can be hermetically sealed at its closure.

In another possible variant, the packaging has a first part made of synthetic material, which is heat-moulded and covered by a second material, either one or both as described previously.

As already stated, the invention is intended more particularly for a moisture-sensitive product, and inter alia a food product. Tests have shown that in the case of a product such as cheese in the form of a soft paste the use of the material according to the invention enables the cheese life to be increased while improving its taste properties. In the case of flowers, the material according to the invention enables the relative humidity to be maintained inside the packaging by water restoration. In the case of meat or similar products the invention enables the juices or exudates of the product to be absorbed while improving the appearance of the product. In the case of dry biscuits, the invention enables the biscuits to retain their stability or crisp character, while preventing their softening. In the case of the packaging of electrical components, the use of the material according to the invention avoids any oxidation.

Without these embodiments having any limiting force, two specific embodiments of the material described above have been considered:

The first embodiment comprises a material in which the support sheet 1 is a paper, the water-retentive material is a polymer, the support sheet 1 and the water-retentive material 2 being connected as follows: the inner surface of the paper is coated with water-retentive powder, which is in turn stuck discontinuously, i.e. linewise, by a cellulose derivative.

In a second embodiment, the material comprises a support which is formed by two layers, namely a polypropylene film and a waxed paper, and a water-retentive material which is a muslin paper coated with acrylonitrile resin. The connection is made as follows: the muslin coated with acrylonitrile resin is fixed on the said support by a resin, namely a cellulose derivative, allowing discontinuous linewise sticking of the water-retentive material to the polypropylene film for the top and to the waxed paper in contact with the product for the bottom.

A number of examples of embodiments of materials according to the invention will now be described without limiting force.

EXAMPLE 1

A material according to the invention was made with the following characteristics: the support sheet was a 40 g/m$^2$ paper 40 microns thick. The water-retentive material was a polyacrylonitrile resin manufactured by Messrs. NORSOLOR under the name AQUAKEEP 10 SH. This polyacrylonitrile resin and the paper were interconnected by spraying the resin on the paper in quantities ranging from 3 to 30 g of resin per m$^2$ of paper and gluing by means of an adhesive adjuvant such as a cellulose derivative. Several cellulose derivatives were used: ethyl and hydroxyethyl cellulose.

The material made in this way was applied to soft cheeses and to compressed cheeses and allowed a 30% water absorption with respect to the initial weight of the packaging and enabled equilibrium to be maintained at the free water activity level of the cheese.

EXAMPLE 2

A material was made comprising a support sheet in accordance with Example 1 connected to a water-retentive material, namely cellulose fibres derived from cotton, with a maximum length of about 6 mm. These cellulose fibres were sprayed in the proportion of 10 to 15 g of fibres per m$^2$ of paper and continuously stuck by a permanent adhesive such as the WAKER resin MV70H.

The use of such a material enables moisture fixation at about 20% of the initial weight of the material. A packaging was made for meat and flowers.

EXAMPLE 3

A material was made which comprised a support sheet according to Example 1 connected to a water-retentive material namely a mineral salt in powder form, e.g. sodium chloride.

This sodium chloride powder, with particles of about 6 microns, was sprayed in the proportion of 3 g per m$^2$ of paper and continuously stuck by a permanent adhesive in emulsion form, namely the WAKER resin MV70H. The use of such material allows moisture absorption and fixation at about 10% of the initial weight of the material, and control of the moisture diffusion.

EXAMPLE 4

A material was made comprising a support sheet, namely a non-woven composite in a weight of 30 g per m$^2$, comprising synthetic and cellulose fibres (Messrs. BOLLORE NH 12+NH 22), connected to a water-retentive material, in accordance with Example 1.

The non-woven and the polyacrylonitrile resin were connected as in Example 3.

EXAMPLE 5

A material was made comprising a support sheet according to Example 4 connected to a water-retentive material according to the Example 2. The non-woven and the cellulose fibres were connected in accordance with Example 3.

EXAMPLE 6

A material was made comprising a support sheet according to Example 4 connected to a water-retentive material according to Example 3.

Similarly, the support sheet and water-retentive material were connected in accordance with Example 3.

EXAMPLE 7

A material was made comprising a support sheet, namely an LMS cellulose film in the proportion of 33.5 g per m$^2$ (PVE AFNOR N 600 g per m$^2$24 hours) connected to a water-retentive material, namely a cross-linked starch (DEXYLOSE 230, reference 3 122 6 L, of Messrs. ROQUETTE).

This cross-linked starch was sprayed in the proportion of 3 g/m$^2$ to the cellulose film and stuck thereto continuously by means of an adjuvant, such as a cellulose derivative (nitrocellulose).

The use of such material allows moisture fixation of about 100% of the initial weight of the cellulose film. One packaging was made for cheese.

EXAMPLE 8

A material was made comprising a support sheet, namely polyvinylchloride of a weight of about 34 g/m$^2$, connected to a water-retentive material, namely a polyacrylonitrile resin of the order of 3 to 30 g/m$^2$.

This polyacrylonitrile resin was sprayed on the polyvinyl chloride and stuck thereto by means of an adjuvant, namely an acrylic derivative which fixes polyacrylonitrile resin. The use of such material enabled 20% of the initial weight of water of the material to be stored. The product was made for packaging mechanical components sensitive to water.

EXAMPLE 9

A material was made comprising a support sheet, namely polypropylene, of a weight of about 18 to 20 g per m$^2$, connected to a water-retentive material in accordance with Example 8. The propylene and polyacrylonitrile resin were connected as in Example 8.

The use of such material allows fixation of the external humidity so that it does not penetrate into the internal atmosphere of the packet. One packaging was made for packing dry biscuits.

EXAMPLE 10

A material was made comprising a support sheet, namely low-density polyethylene of the order of 20 microns, connected to a water-retentive material as in Example 2.

The polyethylene and cellulose fibres were connected as in Example 7. One embodiment of this material was considered for packaging products to provide an absorption function for human hygiene.

EXAMPLE 11

A material was made comprising a double support, namely an aluminium foil 15 microns thick, complexed to paper of a weight of about 40 g, said support being connected to a water-retentive material as in Example 1.

The polyacrylonitrile is dispersed with the glue, i.e. vinyl polymer, so as to connect the polyacrylonitrile to the paper.

Such a material was used for cheeses and dry biscuits to protect them from high humidity, particularly in tropical countries (90% relative humidity at 38° C.).

EXAMPLE 12

A material was made comprising a double support, namely an aluminium foil 15 microns thick complexed to a cellulose film as in Example 7, the support being connected to a water-retentive material as in Example 7.

In this embodiment, the water-retentive material is disposed and glued continuously as in Example 11 between the aluminium foil and the cellulose film.

A packaging of this kind was made for confectionery.

EXAMPLE 13

A material was made comprising a double support formed by an aluminium foil 15 microns thick complexed to a polypropylene connected to a water-retentive material, namely casein.

The casein was sprayed in the proportion of 10 g per m$^2$ on the polypropylene and stuck continuously by means of a permanent adhesive such as the WAKER resin MV70H.

A material of this kind was used for packing soft or compressed cheeses or cheeses of the croûte morgée type, i.e., cheeses of the Beaufort of Comté variety, which have a viscous or tacky rind.

EXAMPLE 14

A material was made comprising a support sheet, namely an aluminium foil 100 microns thick, connected to a water-retentive material, namely cross-linked starch, as in Example 7.

This cross-linked starch was sprayed in a proportion of 6 g per m$^2$ of aluminium and stuck continuously by means of a vinyl acetate.

A pressable material of this kind was used for packaging sterilized Camembert and dry biscuits.

EXAMPLE 15

A material was made comprising a support layer formed by a non-woven composite in a proportion of 31 g/m$^2$ complexed to a muslin paper in the proportion of 18 to 25 g per m$^2$ (KB 20 g of Messrs. METNETT), connected to a water-retentive material, namely a polyacrylonitrile resin.

The water-retentive material was sprayed in the proportion of 3 to 30 g per m$^2$ between the two layers and fixed by gluing, provided by the water-retentive material itself which was previously slightly impregnated with water.

A material of this kind was used for water absorption for domestic drying or for moisture protection in human hygiene.

EXAMPLE 16

A material was made comprising a support formed by an LMS cellulose film (PVE AFNOR 600 g per m$^2$ 24 hours) of the order of 33 g per m$^2$ complexed to a non-woven in accordance with Example 4, said support being connected to a water-retentive material, namely the polyacrylonitrile resin according to Example 1.

The polyacrylonitrile resin was sprayed in a proportion of 3 g per m$^2$ of non-woven and stuck to the latter by lines of glue, using a permanent adhesive such as the WAKER resin MV70H.

A material of this kind was used to line rigid or semi-rigid containers for soft cheeses.

EXAMPLE 17

A material was made comprising a support according to Example 16 connected to a water-retentive material according to Example 7.

The water-retentive material was connected to the support in accordance with Example 16.

A material of this kind was used as in Example 16.

EXAMPLE 18

A material was used comprising a support formed by a layer of a cellulose film (WSZB) and a layer of 40 g waxed paper, in the proportion of 5 to 8 g per m$^2$, said support being associated with a water-retentive material, namely muslin paper (METNETT KB 20 g) in a proportion of 18 to 25 g per $m^2$.

This muslin paper was sprayed between the two layers forming the support and stuck thereto continuously with wax in a proportion of 4.5 g per $m^2$.

A material of this kind was used for soft cheeses and cheeses of the croûte morgée type.

EXAMPLE 19

A material was made comprising a support formed by two layers, the first being microperforate or perforate polypropylene with pores having a diameter of 0.9 mm, the other layer being 40 g paper waxed in a proportion of 5 to 8 g per $m^2$, said support being connected to a water-retentive material as in Example 18.

The water-retentive material was connected to the two layers forming the support by discontinuously sticking linewise with wax in a proportion of 4.5 g per $m^2$.

A material of this kind was used for the same products as indicated in Example 18.

EXAMPLE 20

A material was made comprising a support formed by two layers, one being microperforate polyvinylchloride the other layer being a 40 g paper waxed in a proportion of 5 to 8 g per $m^2$, said support being connected to a water-retentive material as in Example 18.

The water-retentive material was connected to the two layers by sticking the full sheet with wax in the proportion of 4.5 g per $m^2$.

A material of this kind was used for soft cheeses and cheeses of the croûte morgée type.

I claim:

1. A material, in sheet form, for the packaging of a moisture-sensitive food, such as a cheese, comprising in combination at least one support sheet and a coating of at least one water retentive material on said support sheet, said support sheet being selected from the group consisting of paper, cellulose films, regenerated pure cellulose polymers, polyethlylene, polypropylene, polyvinyl chloride and polyester; and said water-retentive material being a water-retentive resin selected from the group consisting of polyacrylonitriles or acrylonitrile-based copolymers, treated with alkaline aqueous solutions of aliphatic or cycloaliphatic mono or polyfunctional alcohols having melting points greater than or equal to 110° C. solutions of aliphatic or cycloaliphatic mono or polyfunctional alcohols of a melting point greater than or equal to 110° C.

2. A material according to claim 1, wherein the support sheet comprises a single layer.

3. A material according to claim 1, wherein the support sheet comprises a plurality of layers.

4. A material according to claim 1, wherein the material also comprises at least one aluminum foil layer connected to a support sheet.

5. A material according to claim 1, wherein the support sheet is gas and/or water vapor proof.

6. A material according to claim 1, wherein the support sheet is permeable to gases and/or water vapor.

7. A material according to claim 1, wherein the water retentive material is incorporated in the support sheets.

8. A material according to claim 1, wherein the water retentive material is superimposed on the support sheet.

9. A material according to claim 1, wherein the connecting means for connecting the water retentive material to the support sheet has an adhesive power and is contained in the water retentive material.

10. A material according to claim 1, wherein the connecting means for connecting the water retentive material to the support sheets has an adhesive power and is formed by an adjuvant.

* * * * *